United States Patent [19]

Marquardt

[11] 4,335,376

[45] Jun. 15, 1982

[54] ELECTRONIC CONTROL DEVICE

[76] Inventor: Ralph E. Marquardt, 2020 Eagle St. North, Cambridge, Ontario, Canada

[21] Appl. No.: 29,558

[22] Filed: Apr. 12, 1979

[51] Int. Cl.[3] ..... G08B 13/08

[52] U.S. Cl. ..... 340/547; 340/528

[58] Field of Search ..... 340/528, 547, 546, 507

[56] References Cited

U.S. PATENT DOCUMENTS

| | | | |
|---|---|---|---|
| 3,820,102 | 6/1974 | Schubert | 340/528 |
| 4,122,437 | 10/1978 | Petersen | 340/528 |
| 4,151,520 | 4/1979 | Full | 340/528 |

*Primary Examiner*—Glen R. Swann, III

*Attorney, Agent, or Firm*—Daryl W. Schnurr

[57] ABSTRACT

A security device for protecting premises having three separate variable time delays. A first time delays allows a legitimate user of the device to enter the premises and de-activate the device before the alarm sounds. The second time delay permits a legitimate user to exit from the premises without sounding the alarm. The third time delay ensures that the alarm will sound for a minimum period once the loop has been opened by an intruder. The device has an integrated circuit and each of the time delays are achieved through the use of a resistor in combination with a capacitor. The device also has a supervisory loop and the alarm becomes activated when the loop has been opened.

9 Claims, 6 Drawing Figures

| A | B | C |
|---|---|---|
| 1 | 0 | 0 |
| 0 | 0 | 1 |
| 1 | 1 | 0 |

ELECTRONIC CONTROL DEVICE

BACKGROUND OF THE INVENTION

1. Field of the Invention

This invention relates to an electronic control device and, in particular, to a security device for residential premises. The device can be used whenever there are two variable functions that can operate a third function when the variable functions are in a predetermined position. The device can be used to control the operation of machines, where said third function is a relay, or as a security device, where said third function is an alarm.

2. Description of the Prior Art

It is known to have electronic control devices which can be used to control machines or as security devices whereby the interruption of the current flow in part of the circuit causes detecting means to become activated. However, some of the previous devices are too expensive or too complex to produce, or they require a relatively large current flow when the device is in standby position, thereby preventing the use of a small battery or number of batteries as the power source, or the devices were not compact or did not operate consistently enough to be relied upon, or the devices had to be re-set manually once the detection means was activated.

A simple and inexpensive electronic control device has been sought by industry and consumers, particularly for use as a security device. Security from intruders who enter private dwelling units is becoming more desirable as the crime rate increases.

SUMMARY OF THE INVENTION

The electronic control device of the present invention comprises the following elements:

(a) Three separate time delays each containing a time delay period;
(b) A suitable direct current power source;
(c) Means for switching the device to on and off positions;
(d) A loop having an open position and a closed position;
(e) An integrated circuit;
(f) Detecting means that become activated for a period of time when the loop has been opened.

The foregoing elements are connected by electronic circuit means so that said power source is connected to said detecting means, switching means and time delays, said time delays and loop being connected to said integrated circuit so that said integrated circuit can control the sequential operation of said time delays in such a manner that when the device is turned on, the first time delay having a first time delay period and preventing the activation of the detecting means even if the loop is opened so long as the loop is closed before said first delay period expires, said device being in standby position with a low direct current flowing through the loop when the loop is closed, the device is turned on and said first delay period has expired; the device moving out of the standby position to a detection position when the loop is or has been opened, the second time delay having a second time delay period and preventing the activation of the detecting means so long as the device is turned off before said second delay period expires. If the device is not turned off within said second delay period, the detecting means is activated and continues to be activated so long as the loop is left open and sufficient power is available. A third time delay means has a third time delay period and delays the shut down of the detecting means after the loop has been closed said detecting means shutting down and said device automatically returning to the standby position when said third time delay period has expired.

BRIEF DESCRIPTION OF THE DRAWINGS

In drawings which illustrate the embodiments of the invention.

DESCRIPTION OF THE PREFERRED EMBODIMENT

Figure 1:
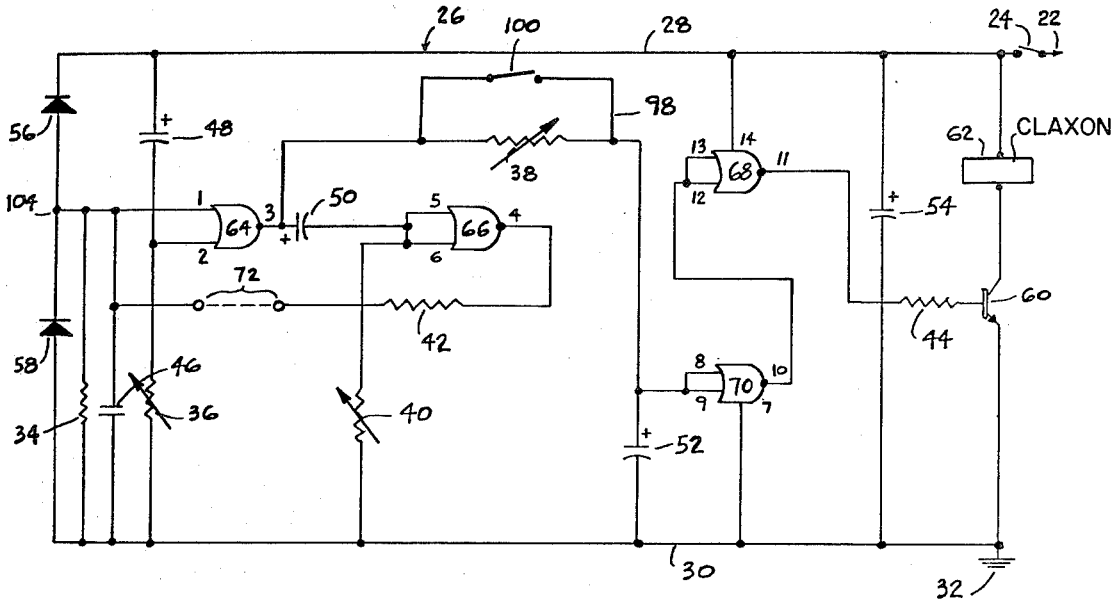
FIG. 1 is a schematic circuit diagram of an electronic circuit of a device according to the invention.

Referring to FIG. 1 in greater detail, a suitable power source is connected at point 22, said source preferrably being a positive 9 to 12 volt d.c. source. The power source can be attained in various ways such as the use of a plug-in transformer or a d.c. adaptor which is plugged into a standard 120 volt a.c. outlet. The power source can also be from batteries, preferrably six size "C" batteries.

An on-off switch 24 is connected between the power source at point 22 and the main part of the circuit 26.

A voltage potential is developed between the line 28 and the line 30 when the switch 24 is in the closed position, the line 30 being grounded as shown at 32. Resistors 34, 36, 38, 40, 42, 44 are shown throughout the circuit 26, resistors 36, 38, 40 being variable resistors. Various capacitors 46, 48, 50, 52, 54, are located throughout the circuit 26.

Signal diodes 56, 58 are located between the lines 28, 30. A transistor 60 is located between the ground 32 and an alarm 62.

An integrated circuit or chip is shown at 64, 66, 68, 70, said chip having the connecting points or pins as numbered 1 to 14 inclusive on FIG. 1. The chip 64, 66, 68, 70 is actually one part but is shown in FIG. 1 as four separate parts to simplify the schematic diagram. A loop 72 is located in the circuit 26 between the resistor 42 and connecting point 1 of the gate 64. Various values of resistors, capacitors and other parts can be used in the circuit and the same results can still be substantially obtained. However, the following types and sizes of parts are preferrably used in the circuit 26:

Resistors 34, 42 and 44 are 3.9 meg-ohms, 10 kilo-ohms and 270 ohms respectively.

Resistors 36, 38, 40 are 3.6 meg-ohms, 2.2 meg-ohms and 2.2 meg-ohms respectively. If variable resistor units are preferrably used the, 4.7 meg-ohm type should be used for all three of the foregoing resistors.

Capacitors 46, 48, 50, 52, 54 are 0.1 microfarads, 4.7 micro-farads, 47 micro-farads, 4.7 micro-farads and 4.7 micro-farads respectively.

Signal diodes 56, 58 are each numbered 2N 4148.

Transistor 60 is numbered 2N 4401.

Alarm 62 is a standard claxton alarm.

The chip 64, 66, 68, 70 is numbered I.C. 14001 Quad Nor Gate.

Figure 2:
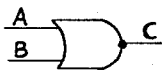
FIG. 2 is a schematic of the integrated circuit used with an accompanying table showing the operation of the integrated circuit.

The operation of the integrated circuit is best seen from FIG. 2. Where the numeral one represents a positive potential and zero a negative potential, it can be seen that there will be no output from the gates 64, 66, 68, 70 unless both of the inputs on any particular gate have a negative potential. For example, referring to gate 64, unless inputs 1, 2 (ie. A,B, in FIG. 2) are both negative, there will be no output at 3 (ie. C in FIG. 2).

In operation, when the switch 24 of the circuit 26 is in the closed position there is a difference of potential between the lines 28 and the lines 30. Current is coupled through capacitor 48 maintaining pin 2 positive, thereby preventing any output at 3 regardless of whether pin 1 is positive or negative. Capacitor 48 takes approximately 8 to 10 seconds to become fully charged through resistor 36 and thereafter no further current is coupled through capacitor 48. At that time, pin 2 becomes negative because of the connection to ground through resistor 36. Assuming that the loop 72 is in the closed position, pin 1 is positive because of feedback from pin 4 through resistor 42 and loop 72. Since pin 1 is positive and pin 2 is negative, pin 3 is negative. Therefore, there is no output at pin 3. Pins 5 and 6 are made negative through their connection to ground through resistor 40. When pins 5, 6 become negative, pin 4 becomes positive. When the loop 72 is in the closed position, pin 4 is connected through the relatively small resistor 42 to pin 1 and maintains pin 1 positive. There is no flow of current through resistor 38 when the loop 72 is closed as pin 3 is negative and there is no output at pin 3. The capacitor 48 and resistor 36 represent the first time delay and the alarm 62 cannot sound until the capacitor 48 is fully charged through resistor 36 even though the loop 72 has been opened. After the capacitor 48 is fully charged through resistor 36 and the loop 72 remains closed, there is a low direct current flowing in the line from pin 4 to pin 1 of approximately 5 to 8 microamps and the device is said to be in standby position.

When the loop 72 is opened, current can no longer flow from pin 4 to pin 1 and therefore pin 1 becomes negative. When pin 1 becomes negative, pin 3 becomes positive and current flows through resistor 38 and instantly begins to charge capacitor 50. The current flows through resistor 38 and is coupled through capacitor 52 to ground 32. However, after 8 to 10 seconds, capacitor 52 becomes fully charged through resistor 38 and the current is directed to pins 8, 9. Capacitor 52 and resistor 38 is the second time delay and so long as the switch 24 is turned to the off position before capacitor 52 is fully charged, the alarm 62 will not sound. In other words, the second time delay prevents the activation of the detecting means, being the alarm 62 and so long as the device is turned off within the second time period the alarm 62 will not sound. However, assuming that the switch 24 is left in the on position, pins 8 and 9 become positive making pin 10 negative. Pin 10 makes pins 12 and 13 negative and results in pin 11 becoming positive. When pin 11 becomes positive, current flows through resistor 44 and biases transistor 60 and the alarm 62 sounds. When there is no current flowing through resistor 38, pins 8 and 9 are negative pin 10 is positive and pins 12 and 13 are positive. When pins 12 and 13 are positive, pin 11 is negative maintaining transistor 60 in a cut-off state. As long as the loop 72 remains open, the alarm 62 will sound provided that there is sufficient power in the power source connected at point 22. The device moves from the standby position to a detection position as soon as the loop is opened.

However, when the loop 72 is closed, a positive path is again provided from pin 4 through resistor 42 to pin 1. Due to the charge which was applied to capacitor 50 when loop 72 was initally opened, pins 5 and 6 remain positive for period of time determined by values of capacitor 50 and resistor 40. Using the values indicated above this time is approximately 2 to 2.5 minutes. When said third time delay period expires, pins 5 and 6 become negative. This makes pin 4 positive, which in turn causes pin 1 to become positive. This third time delay is provided by capacitor 50 and resistor 40 and even though pin 1 is positive and there is no output at pin 2 the alarm will continue to sound until capacitor 50 is discharged. Thus, when capacitor 50 has been discharged, the device will automatically have returned to the standby condition. When pin 4 is made positive by pins 5 and 6 becoming negative, potential pin 1 is again made positive making pin 3 negative, pins 8 and 9 negative, pin 10 positive, pins 12 and 13 positive, pin 4, and pin 11 negative which removes the bias voltage from base of transistor 60 through resistor 44, which drives transistor 60 into cut-off causing alarm 62 to stop. As soon as the alarm 62 stops the device automatically returns to the standby position because there is no output from pin 3 and pin 4 is positive.

If the loop 72 is re-opened after the device returns to standby position, the alarm will sound again. The time delay period through capacitors 52 and 50 may be somewhat shortened if these capacitors have not had sufficient time to discharge or drain completely.

Once the device is in the standby position, even if the loop 72 is opened for a fraction of a second and then closed, the alarm will sound after the second time delay has expired and the capacitor 52 is fully charged through resistor 38. The alarm will sound for the full length of the third time delay period, that is, until capacitor 50 is fully charged through resistor 40. The alarm 62 sounds even though the loop 72 has been opened only for a fraction of a second because that fraction of a second is sufficient to cut-off the current from pin 4 to pin 1, thereby making pin 1 negative and pin 3 positive. This charge causes the chain reaction through the various pins, as discussed above, with the result that pin 11 becomes positive.

Capacitor 54 charges up to the applied voltage upon closure of the switch 24. When the circuit 26 goes into alarm state with claxon type of alarm 62, spikes appear on line 28. If capacitor 54 was not operating, these spikes could and would interfere with re-set operation of said circuit 24.

When a relay is substituted for alarm 62, these spikes are not present and capacitor 54 may not be required.

When capacitor 50 becomes fully charged and the alarm 62 shuts down, fluctuations or spikes may occur in the current flowing from pin 4 to pin 1. Capacitor 46 and resistor 34 filter these fluctuations to ground 32 and prevent interaction to pin 1.

Figure 3:
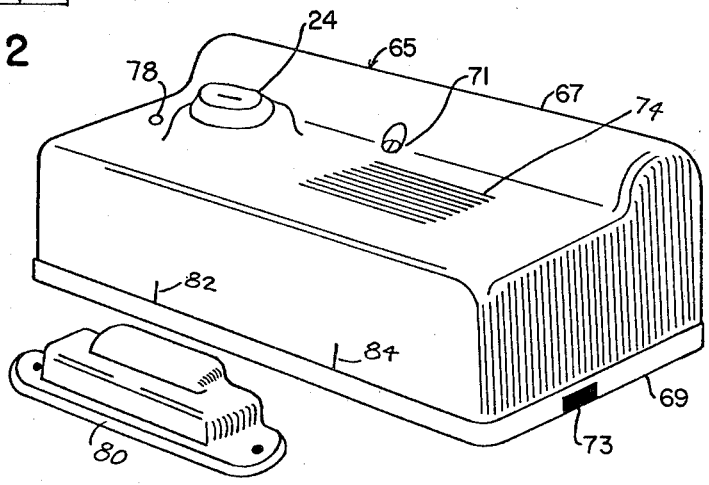
FIG. 3 is a perspective view of a housing enclosing the circuit and also showing a contact component.

In FIG. 3, there is shown a housing 65 which encloses the actual circuit 26 and can also contain six size "C" batteries, if that is the desired power source. The housing 65 consists of a cover 67 and a backing 69. A screw 70 supports the cover 67 against the backing 69. The housing 65 can be made of any suitable material but is preferrably made of A.B.S. (acryla butylene styrene) plastic or cycolac (a trade mark of Borg-Warner Corporation).

When the screw 71 is removed, the cover 67 can readily be separated from the backing 69 simply by inserting a screw driver or another blunt object into slot 73 and prying the two parts 67,69 apart. The alarm 62 of the circuit is located directly below vents 74 in the cover 67. The on-off switch 24 is represented by a camlock and is operated by means of a key (not shown). Notch 78 is provided to indicate the on or off position of the device, a signal light (not shown) lights up when the switch 24 is turned on and current is passing through the device.

Also shown in FIG. 3, is a contact component 80.

There are two models of the device, one having the loop 72 located within the housing 65 and a magnetic contact component or actuator 80 located external to the housing 65. Lines 82, 84 are located on the outside of the housing 65 as a guide during installation in order that the contact 80 can be properly located relative to the loop 72.

The contact component 80 contains a permanent magnet (not shown) and the loop 72 is represented by a dry reed switch (not shown). When the magnet of the contact component 80 is placed in close proximity to the reed switch of loop 72, said magnet draws the two ends of the reed switch directly together, thereby closing the loop 72. When the magnet in the contact component 80 is moved away from the lines 82, 84 and the loop 72, the loop opens.

Figure 4:
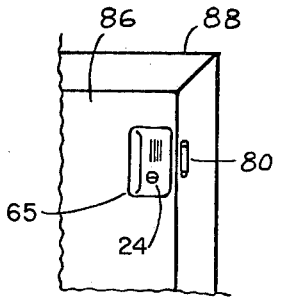
FIG. 4 is a front view of the device as mounted on a door, said device having only one external contact component.

In FIG. 4, the housing 65 of the security alarm and the contact component 80 shown in FIG. 3 are shown mounted on a door 86 and a frame 88 respectively. Of course, the housing 65 of the security device could be mounted on the frame 88 and the contact could be mounted on the door 86.

Figure 5:
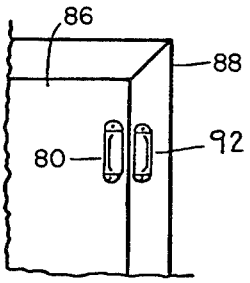
FIG. 5 shows two external contact components mounted on a door.

In FIG. 5, two contact components 80, 92 are shown mounted on a door 86 and a frame 88 respectively. This is simply another model of the invention and one of the contact components preferrably the one mounted on the frame 88 will contain the dry reed switch or loop 72 and the other contact will contain the permanent magnet. The loop 72 operates in exactly the same manner as with the one external contact component 80 described in FIG. 4. The only difference is that the loop is external to the security device. Of course, the contact component 92, which preferrably contains the loop 72, must be wired directly to the security device which can be located in any convenient location. No wires are required for the contact component 80, which would then contain said magnet.

When used by a consumer, a security device in accordance with the present invention would preferrably be operated in the following manner. Assuming that the device was mounted on a door and frame as shown in FIG. 4, when the owner of the device was leaving his housing unit, he would insert a key into the lock 24 and turn the device on. Once the device was turned on, the user would have approximately 8 to 10 seconds to leave the housing unit and close the door behind him. This is the first time delay period and is the period during which capacitor 48 is charging through resistor 36. Assuming that the door is closed within this first time delay period, the internal loop 72 and the contact component 80 will again be in close proximity and the loop 72 will be closed. Thus, the alarm will not sound.

When the home owner returns home, he would again have 8 to 10 seconds to open the door and insert his key into the lock 24 and turn off the device 65. This is the second time delay period and is the time during which capacitor 52 is charging through resistor 38. As long as the device is turned off before the expiry of said second time delay period, the alarm 62 again will not sound.

Assuming that the home owner turned on the device and left his housing unit as before but the door was opened by someone else before the home owner returned home, the alarm 62 will sound whether the door is left open by the intruder or whether it is opened and closed within a fraction of a second. The alarm 62 will not sound immediately but there will be a slight delay of 8 to 10 seconds while capacitor 52 is charging through resistor 38. Once capacitor 52 is fully charged, the alarm will sound. If the door remains open, the alarm will sound continuously as long as the door remains open and there is sufficient power remaining in the power source. With six new size "C" batteries, the alarm will sound for approximately 24 hours. After the door is closed, the alarm will sound for 2 to 2.5 minutes. This is the third time delay period and is the time that it takes for capacitor 50 to become fully charged through resistor 40 and fully discharged. When the capacitor 50 becomes discharged the device automatically returns to the standby condition.

If resistors 36, 38, 40 are 4.7 meg-ohm variable resistors, the first and second time delay periods are variable from 0–20 seconds. The third time delay period is variable from 0–5.5 minutes. While it is preferable that all of the resistors 36, 38, 40 be variable, this is not essential. It will readily be apparent to those skilled in the art that if a non-variable resistor is used as a replacement for any or all of resistors 36, 38, 40, that the time delay period related to the particular non-variable resistor will be a fixed time period.

The device of the present invention can be used as a security device on various objects including doors, windows, desks, safes, closets, rooms, etc. It can also be used as a control device whenever there are two variable functions where it is desired to actuate a third function. It is also possible to have one central security device with various external contact component pairs on various windows, doors, etc.

Referring to FIG. 1, there is shown a by-pass 98 containing a switch 100 to short out resistor 38 when the switch 100 is closed. This is an optional feature of the security device and is designed for use by a customer when he is occupying his housing unit. If the customer or home owner closes the switch 100, resistor 38 will be by-passed when the loop 72 is opened and the capacitor 52 will be fully charged almost instantaneously. This will eliminate the second time delay period and the alarm will sound as soon as the door is opened without the 8 to 10 second delay.

Figure 6:
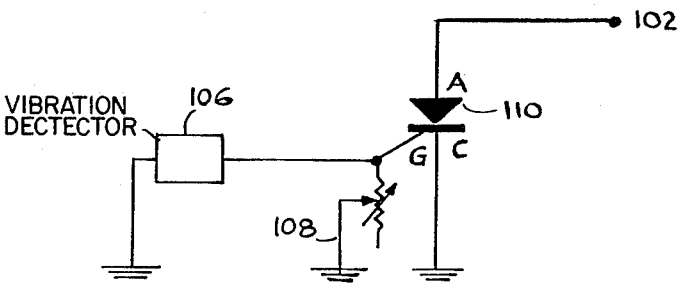
FIG. 6 is a schematic circuit diagram showing additional elements that would activate the detecting means upon the vibration of the device rather than the opening of the loop.

In FIG. 6, there is shown a further variation of the device. The circuit shown in FIG. 6 is designed to be added to the circuit shown in FIG. 1 so that point 102 on FIG. 6 is connected directly to point 104 on FIG. 1. The circuit in FIG. 6 contains any standard vibration pick-up or detector 106, a 200 kilo-ohm potentiometer 108 and a silicon control rectifier 110, being number 2N 5064 or equivalent. This variation can be used individually or in conjunction with the loop 72. The effect of this variation is to change pin 1 from positive to negative. The potentiometer 108 is used to control the input signal to the gate of the rectifier gate 110.

In operation, the variation in FIG. 6 operates when the vibration pick-up 106 senses vibrations. When this occurs, the gate of the silicon control rectifier 110 opens and drives the diode of said rectifier into conduction. Since point 102 is connected directly to ground, this creates a negative potential in point 102 which in turn creates a negative potential in point 104 and pin 1. Since pin 1 is negative, the same results occur as if the loop 72 were opened and the alarm ultimately sounds. This variation is useful when the security device of the present invention is used to secure motor vehicles, travel trailers, display cabinets, etc. As soon as the motor vehicle is vibrated, whether a potential intruder is attempting to open the door, remove a tire, or move the vehicle, the alarm will sound with the likely result that the intruder will be discouraged and leave the scene. The variation in FIG. 6 could also be used to secure housing units or other property. For example, when a potential intruder causes a vibration to a door in attempting to open it, the alarm will sound and the intruder will likely flee from the premises. This has the added advantage in that the alarm sounds before entry is actually made.

What I claim as my invention is:

1. An electronic control device comprising the following elements:

(a) three separate time delays each creating a time delay period;

(b) a suitable direct current power source;

(c) means for switching the device on and off;

(d) a loop having an open position and a closed position;

(e) an integrated circuit;

(f) detecting means that becomes activated for a period of time when the loop has been opened, said elements being connected by electronic circuit means so that said power source is connected to said detecting means, switching means and time delays, said time delays and loop being connected to said integrated circuit so that said integrated circuit can control the sequential operation of said time delays in such a manner that when said device is turned on, the first time delay having a first time delay period and preventing the activation of the detecting means even if the loop is open so long as the loop is closed before said first delay period expires, said device being in standby position with a low direct current flowing through the loop when the loop is closed, the device is turned on, and said first delay period has expired; the device moving out of standby to a detection position when the loop is or has been opened, the second time delay having a second time delay period and preventing the activation of the detecting means so long as the device is turned off before said second delay period expires, the detecting means being activated if the device is not turned off within said second delay period, said detecting means continuing to be activated so long as the loop is left open and sufficient power is available, with a third time delay means having a third time delay period to delay the shut down of the detecting means after the loop has been closed, said detecting means shutting down and said device automatically returning to the standby position when said third time period has expired.

2. The device of claim 1 wherein at least one of the time delays is variable.

3. The device of claim 1 wherein the power source ranges from a positive 9 volts to 12 volts and the current through the loop while the device is in the standby position ranges from 5 micro-amps to 8 micro-amps.

4. The device of claim 3 wherein the device is a security alarm and the loop is in the closed position when located in close proximity to a suitable actuator and in the open position when moved from proximity with the suitable actuator.

5. The device of claim 4 wherein the detecting means is an alarm.

6. The device of any of claims 1, 2 or 3 wherein a by-pass is added to short out the second time delay so that the detecting means will be activated immediately upon the opening of the loop when the device is moved from the standby position to the detection position.

7. The device of any of claims 1, 2 or 3 wherein a vibration pick up is connected into the integrated circuit so that the detecting means operates upon vibration of the device.

8. The device of claim 4 wherein the elements in the electronic circuit means are located within a housing and said actuator is located external to the housing.

9. The device of any of claims 4, 5 or 8 wherein the on/off switch can only be operated by using a key.

* * * * *